US007927656B2

(12) United States Patent
Mantkowski

(10) Patent No.: US 7,927,656 B2
(45) Date of Patent: Apr. 19, 2011

(54) METHOD AND APPARATUS FOR CONTROLLING DIFFUSION COATING OF INTERNAL PASSAGES

(75) Inventor: Thomas Edward Mantkowski, Madeira, OH (US)

(73) Assignee: General Electric Company, Schenectady, NY (US)

( * ) Notice: Subject to any disclaimer, the term of this patent is extended or adjusted under 35 U.S.C. 154(b) by 923 days.

(21) Appl. No.: 11/469,052

(22) Filed: Aug. 31, 2006

(65) Prior Publication Data

US 2008/0057193 A1 Mar. 6, 2008

(51) Int. Cl.
*B05D 7/22* (2006.01)

(52) U.S. Cl. ..... 427/237; 427/248.1

(58) Field of Classification Search ..... 427/237, 427/248.1, 250; 118/715
See application file for complete search history.

(56) References Cited

U.S. PATENT DOCUMENTS 3,075,494 A 1/1963 Toulmin, Jr.
3,658,585 A 4/1972 Folkmann et al.
4,872,475 A * 10/1989 Xiang-Wei ..... 137/493
5,221,354 A 6/1993 Rigney
5,368,888 A 11/1994 Rigney
5,464,479 A * 11/1995 Kenton et al. ..... 134/1
5,824,366 A * 10/1998 Bose et al. ..... 427/239
6,180,170 B1 * 1/2001 Grossmann et al. ..... 427/237
6,273,678 B1 * 8/2001 Darolia ..... 415/200
6,332,926 B1 12/2001 Pfaendtner et al.
6,616,969 B2 * 9/2003 Pfaendtner et al. ..... 427/237
6,929,825 B2 * 8/2005 Wustman et al. ..... 427/250

* cited by examiner

*Primary Examiner* — Timothy H Meeks
*Assistant Examiner* — Elizabeth Burkhart
(74) *Attorney, Agent, or Firm* — William Scott Andes; Gary M. Hartman; Domenica N.S. Hartman

(57) ABSTRACT

A method and apparatus for controlling the thickness of a coating deposited on internal passages of a component. The coating is a diffusion coating, preferably a diffusion aluminide coating, deposited by a vapor phase process that entails placing a component within a coating chamber so that first and second conduits fluidically communicate with first and second openings in the component. The component is heated within the coating chamber, at least one reactive vapor is generated within the coating chamber, and a carrier gas is delivered through the first conduit to force the reactive vapor to enter the internal passages through the first opening in the component and exit through the second opening. Flow of the carrier gas is then reversed so that the carrier gas is then delivered through the second conduit to force the reactive vapor to enter the internal passages through the second opening and exit through the first opening.

10 Claims, 2 Drawing Sheets

METHOD AND APPARATUS FOR CONTROLLING DIFFUSION COATING OF INTERNAL PASSAGES

BACKGROUND OF THE INVENTION

The present invention generally relates to protective coatings for components exposed to high temperatures within a chemically and thermally hostile environment. More particularly, this invention is directed to a method and apparatus for controlling the deposition of a diffusion coating on internal passages of a component, such as an air-cooled gas turbine engine component, so as to promote a more uniform coating thickness that is better capable of protecting the internal passages from oxidation and corrosion.

The operating environment within a gas turbine engine is both thermally and chemically hostile. As higher operating temperatures for gas turbine engines are continuously sought in order to increase their efficiency, the high temperature durability of the components within the hot gas path of the engine must correspondingly increase. Significant advances in high temperature capabilities have been achieved through the formulation of iron, nickel, and cobalt-base superalloys. Nonetheless, when used to form certain components of the turbine, combustor, and augmentor sections of a gas turbine engine, superalloys are often susceptible to damage by oxidation and hot corrosion attack and may not retain adequate mechanical properties.

A common solution is to protect the surfaces of such components with an environmental coating, i.e., a coating that is resistant to environmental attack, typically in the form of oxidation and hot corrosion. Coatings that have found wide use for this purpose include diffusion coatings, such as diffusion aluminides and chromides, and overlay coatings such as MCrAlX (where M is nickel, cobalt and/or iron and X is X is yttrium or a rare earth or reactive element). During high temperature exposure in air, these coatings form a protective oxide scale that inhibits oxidation of the coating and the underlying substrate. Diffusion aluminide coatings are particularly useful for providing environmental protection to components equipped with internal cooling passages, such as high pressure turbine blades, because aluminides are able to provide environmental protection on the cooling passages without significantly reducing their cross-sections, which otherwise would lead to insufficient cooling flow and shortened life of the component.

Diffusion coating processes, such as pack cementation, vapor phase (gas phase) aluminiding (VPA), and chemical vapor deposition (CVD), generally entail contacting the surface to be coated with a reactive vapor that contains the desired material to be deposited, often aluminum. In the case of vapor phase aluminiding, a source of aluminum (for example, $CO_2Al_5$) and a halide salt activator (for example, $AlF_3$, $NH_4F$, KF, $NH_4Cl$) are placed in a container along with the components to be coated, and the container is then placed in a retort that provides a gas shield for the container. The retort is heated to cause the activator to react with the aluminum source and form a volatile aluminum halide, which then reacts at the component surfaces to form the diffusion coating. An outermost zone of the coating is often termed an additive layer that contains the environmentally-resistant intermetallic phase MAI, where M is iron, nickel or cobalt, depending on the substrate material. A diffusion zone (DZ) forms within the substrate beneath the additive layer, and contains various intermetallic and metastable phases that form during the coating reaction as a result of diffusional gradients and changes in elemental solubility in the local region of the substrate. During high temperature exposure in air, the additive layer forms the desired alumina scale that inhibits oxidation of the diffusion coating and the underlying substrate. Typical thicknesses for diffusion aluminide coatings are about 30 to 75 micrometers for the additive layer and about 25 to 50 micrometers for the diffusion zone.

Achieving a suitable diffusion coating thickness, uniformity, and internal/external thickness ratio for an air-cooled component can be difficult, particularly for turbine blades with complex external geometries and cooling passage designs. To control the amount of coating deposited on the internal passages of a turbine blade, the reactive aluminum halide vapor is typically forced through the internal passages. For example, the reactive vapors can be introduced into the blade through its root and flow through the internal passages before exiting through cooling holes at the component surface, for example, film cooling or blade tip holes in the airfoil surfaces of the blade. Alternatively, the coating vapors can be forced to enter through the cooling holes and exit at the blade root.

The reactivity of the coating vapor decreases as it flows through the blade and deposits aluminum, resulting in a thinner coating (and potentially no coating) near the exit points. If the coating operation is extended to increase the coating thickness at the exit points, the coating can become excessively thick in the vicinity where the vapors entered the blade and on the external surfaces. Because excessive coating thickness can adversely impact airflow and reduce the strength of the underlying alloy, a blade with this condition is subject to rejection at the manufacturing level. As such, controlling the relative thickness distribution inside a blade would be beneficial to achieving the required protection in service without incurring a reduction in material properties due to overly thick coatings in high stress areas, such as the blade shank.

BRIEF SUMMARY OF THE INVENTION

The present invention generally provides a method and apparatus for controlling the deposition of a diffusion coating on internal passages of a component, such as an air-cooled gas turbine engine component. The coating, such as a diffusion aluminide coating, is deposited by a vapor phase process to have a more uniform or better controlled coating thickness that is better capable of more uniformly protecting the internal passages from oxidation and corrosion.

The method generally entails placing a component within a coating chamber so that at least a first conduit fluidically communicates with at least a first opening in the component and a second conduit fluidically communicates with at least a second opening in the component. The component is heated within the coating chamber, and a reactive vapor is generated within the coating chamber. A carrier gas is then delivered through the first conduit to force a first quantity of the reactive vapor to enter the internal passages through at least the first opening in the component, flow through the internal passages in a first direction, and exit the component through at least the second opening in the component. During this time, the first quantity of the reactive vapor forms a first portion of the diffusion coating on the surfaces of the internal passages as the first quantity of the reactive vapor flows therethrough. The carrier gas is then delivered through the second conduit to force a second quantity of the reactive vapor to enter the internal passages through at least the second opening in the component, flow through the internal passages in a second direction opposite the first direction, and exit the component through at least the first opening in the component. During this time, the second quantity of the reactive vapor forms a second portion of the diffusion coating on the surfaces of the internal passages as the second quantity of the reactive vapor flows therethrough.

The apparatus of the invention includes at least first and second conduits that fluidically communicate with at least first and second openings, respectively, in a component located within a coating chamber, means for heating the component within the coating chamber, means for generating a reactive vapor within the coating chamber, first means for delivering a carrier gas through the first conduit, and second means for delivering the carrier gas through the second conduit. The first delivery means is adapted to force a first quantity of the reactive vapor to enter the internal passages through at least the first opening in the component, flow through the internal passages in a first direction, and exit the component through at least the second opening in the component, and the second delivery means forces a second quantity of the reactive vapor to enter the internal passages through at least the second opening in the component, flow through the internal passages in a second direction opposite the first direction, and exit the component through at least the first opening in the component. In this manner, the first and second delivery means are operable to cause, respectively, the first and second quantities of the reactive vapor to form first and second portions of the diffusion coating on the surfaces of the internal passages as the first and second quantities of the reactive vapor flows therethrough.

According to a preferred aspect of the invention, the final thickness of the diffusion coating adjacent the first and second openings are approximately equal to each other as a result of reversing flow of the reactive vapor within the component, through which the flow direction of the vapor can be reversed any number of times. As such, the uniformity of the diffusion coating within the internal passages can be promoted to the extent that the resistance of the internal passages to oxidation and corrosion is improved while also avoiding excessive buildup of the coating within the passages that could adversely impact airflow, material properties, and flow distribution through the internal passages.

Other objects and advantages of this invention will be better appreciated from the following detailed description.

DETAILED DESCRIPTION OF THE INVENTION

The present invention is generally applicable to components that operate within thermally and chemically hostile environments, and are therefore subjected to environmental attack such as oxidation and hot corrosion. Notable examples of such components include the high and low pressure turbine nozzles, blades and shrouds of gas turbine engines. While the advantages of this invention will be described with reference to certain gas turbine engine hardware, the teachings of the invention are generally applicable to any component that would benefit from an environmental coating to protect the component from its environment.

Figure 2:
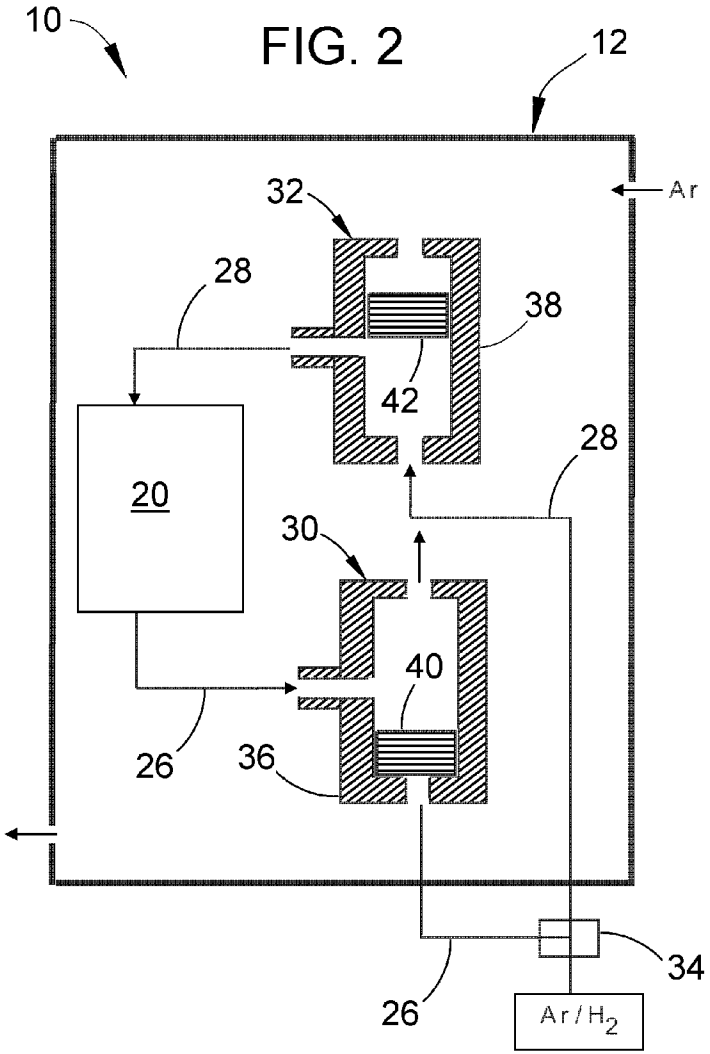
FIG. 2 schematically represents the vapor flow system of FIG. 1 operating in a reverse flow mode in accordance with an embodiment of the invention.
Figure 1:
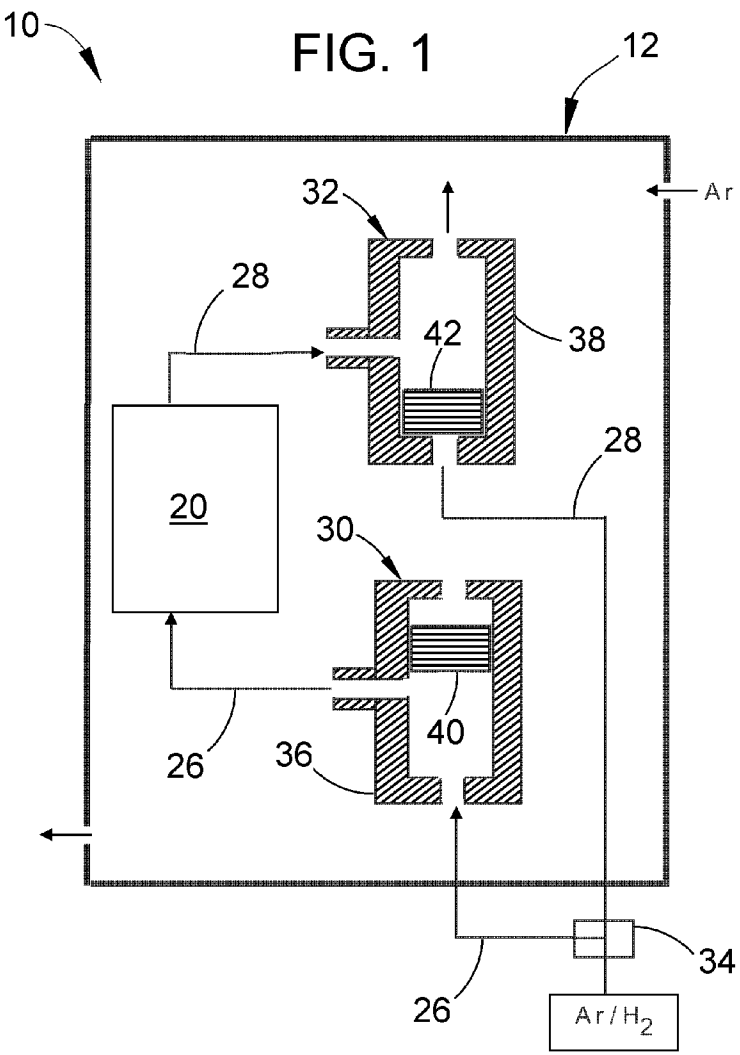
FIG. 1 schematically represents a vapor flow system operating in a forward flow mode in accordance with an embodiment of the invention.

FIGS. 1 and 2 schematically represent a system 10 for controlling the flow of a reactive vapor through internal passages within a component to form a diffusion coating on the internal passages. As depicted, the system 10 includes a retort 12 in which the vapor phase coating process of this invention can be carried out. The retort 12 is schematically represented as containing a coating chamber or can 20 that, as explained in more detail below, contains one or more activators and source (donor) materials that react to generate the reactive vapor. Two conduits 26 and 28 are coupled to the can 20 for the purpose of transmitting a carrier gas to and from the can 20. Shuttle valves 30 and 32 are located in the flow path of each conduit 26 and 28, and the carrier gas from a suitable source is selectively supplied to each conduit 26 and 28 via a valve assembly 34. In FIG. 1, the valve assembly 34 is represented as supplying the carrier gas to one end of the can 20 through the conduit 26 and its shuttle valve 30, whereas the conduit 28 and its shuttle valve 32 operate to vent the can 20. As with conventional vapor phase deposition processes known in the art, the interior of the retort 12 is initially purged with an inert gas, such as argon, prior to the coating operation, and an inert gas continues to flow through the retort 12 to prevent air from leaking into the retort during the coating process.

Each shuttle valve 30 and 32 is shown as generally comprising a housing 36 and 38 that contains a float 40 and 42. Because the shuttle valves 30 and 32 are intended to operate within the retort 12 and vent hot reactive vapors, the valves 30 and 32 are subject to the high processing temperatures occurring in the retort 12 as well as unintentional coating. For this reason, the housings 36 and 38 are preferably formed of molybdenum, tungsten, or alloys thereof, and the floats 40 and 42 are preferably formed of graphite to have low density and low thermal expansion to match the housings 36 and 38. However, those skilled in the art will appreciate that other materials could also be used. In FIG. 1, the shuttle valve 30 is shown as allowing the flow of the carrier gas through the conduit 26 as a result of the carrier gas lifting the float 40 above the outlet of the housing 36. In contrast, gravity forces the float 42 against the lower end of the valve housing 38, preventing the reactive vapors from being delivered to the valve assembly 34 outside the retort 12 and forcing the venting of the reactive vapors within the retort 12. FIG. 2 represents flow directions through the system 10 that are the reverse of that shown in FIG. 1.

The valve assembly 34 is located outside the retort 12, and therefore is not subjected to the same severe conditions as the shuttle valves 30 and 32. Furthermore, the shuttle valves 30 and 32 prevent the hot reactive vapors from entering the valve assembly 34, such that only the carrier gas (preferably an inert or reducing gas such as argon or hydrogen, respectively) at a relatively low temperature contacts the valve assembly 34. As represented, the valve assembly 34 is a three-way valve, such as a conventional solenoid-operated three-way valve of a type commercially available and used to control fluid systems. However, it should be understood that essentially the same function desired of the valve assembly 34 could be achieved with two solenoid valves acting out of phase, as well as other types of valve arrangements.

Figure 3:
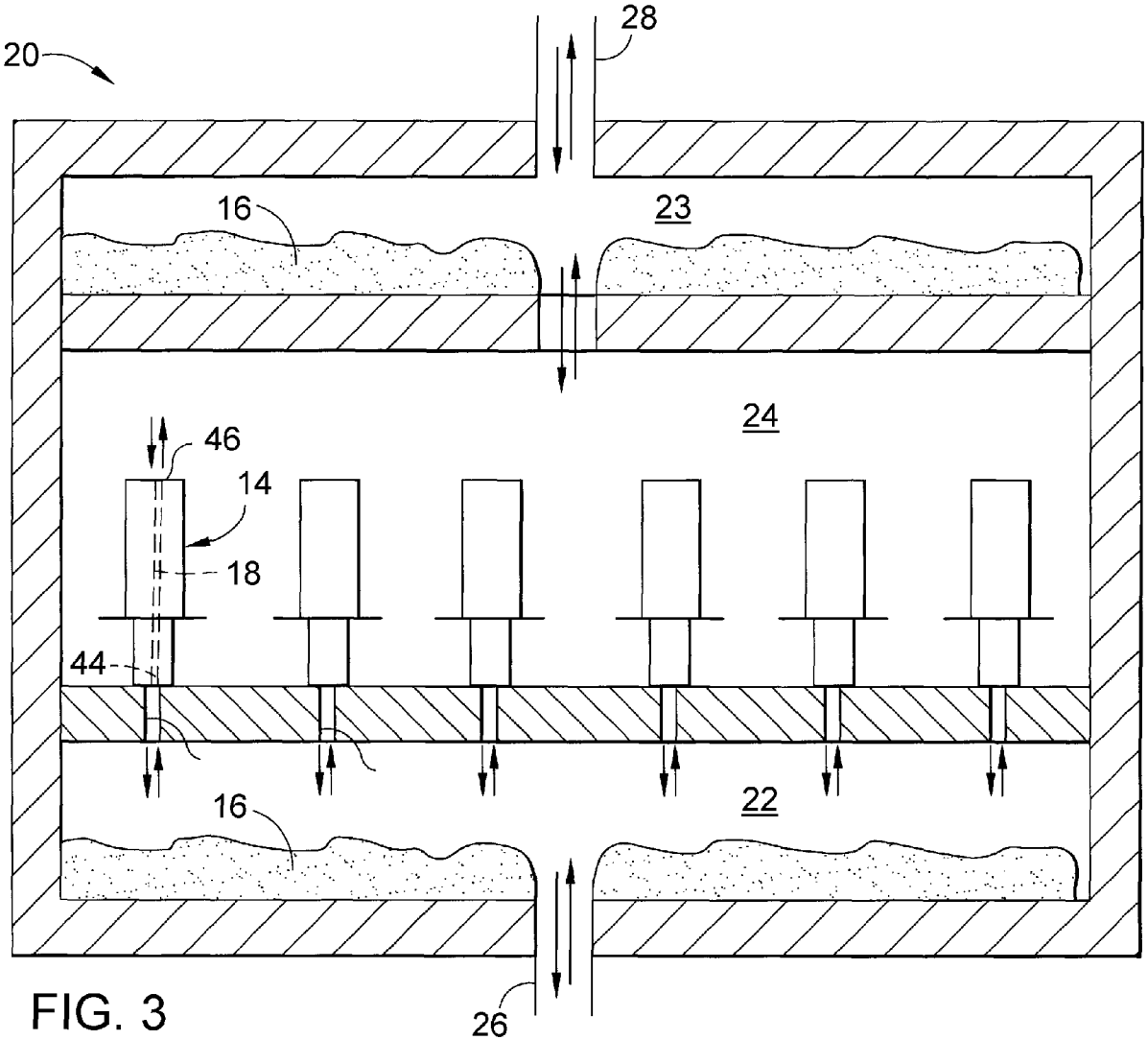
FIG. 3 is a sectional view of a coating can suitable for use with the vapor flow system of FIGS. 1 and 2.

A suitable configuration for the coating can 20 is schematically represented in FIG. 3. As with conventional vapor phase deposition processes known in the art, the coating process of this invention is carried out in an inert or reducing atmosphere provided by the carrier gas within the can 20. The can 20 is represented in FIG. 3 as containing components, represented as turbine blades 14, to be coated by reactive vapors generated from donor mixtures 16 within the can 20. The donor mixtures 16 are preferably in a granular or pellet form, though other forms may also be used, and may contain any of the previously noted donor and activator materials, though the use of other materials is also possible. If a diffusion aluminide coating is desired, particularly suitable donor materials include aluminum alloy particles and suitable activators include ammonium, aluminum, or alkali metal halides. If aluminum halide (e.g., $AlF_3$) is used as the donor material, a separate activator may not be required. Chromium is a suitable donor material for producing a chromide coating, with suitable activators including ammonium or alkali metal halides. The donor mixtures 16 may also contain a material to inhibit sintering of the donor material particles. Calcined alumina or another material that remains unreactive during the coating process is widely used for this purpose. Other than the aspects of invention as described below, conventional coating materials and conditions can be used with this invention, including coating temperatures (e.g., about 950° C. to about 1150° C.) and coating durations (e.g., about two to about ten hours).

In the embodiment shown in FIG. 3, two separate quantities of the donor mixture 16 are placed out of contact with the blades 14 to be coated, as a result of being located in chambers 22 and 23 fluidically connected to a chamber 24 containing the blades 14. Alternatively, the chambers 22 and 23 could be separate from the inner chamber 24 and the remainder of the can 20 but fluidically coupled to the chamber 24, or the upper chamber 23 could be eliminated and the donor material and activator for the reverse flow could be located in the chamber 24. As seen in FIG. 3, the blades 14 have internal passages 18 that fluidically connect the lower chamber 22 with the chamber 24 containing the blades 14. For convenience, only one passage 18 of a single blade 14 is shown in FIG. 3, and the passage 18 is represented as being straight with a single opening 44 in the root section of the blade 14 and a single cooling hole 46 at the blade tip. However, it should be understood that passages with complex geometries and any number of additional openings 44 and cooling holes 46 could be present in the blades 14.

The entire retort 12 and its contents are heated, such as by being placed in a furnace, to a temperature at which the activators will react with the donor materials to generate the reactive vapors, which at the elevated temperature then react with exposed surfaces to deposit diffusion coatings on at least portions of the internal passages 18 within the blades 14, and preferably also the external surfaces of the blades 14. The donor mixtures 16 within the chambers 22 and 23 can be of the same composition, or have different compositions to deposit different coating compositions, such as an aluminide coating on certain regions of the blades 14 and a chromide coating on other regions of the blades 14. Furthermore, the mixtures 16 may differ in terms of vapor activity level, for example, to compensate for differing rates of vapor depletion that may occur as the vapors travel through the passages 18 during deposition.

The conduits 26 and 28 are shown coupled to the can 20 so that carrier gas entering the lower end of the can 20 (as viewed in FIG. 3) through the conduit 26 forces reactive vapor from the lower chamber 22 into the passage 18 of each blade 14 through the opening 44 in the blade root section. Conversely, carrier gas entering the upper end of the can 20 (as viewed in FIG. 3) through the conduit 28 forces reactive vapor from the upper chamber 23 into the passage 18 of each blade 14 through the cooling hole 46 at the blade tip. As the reactive vapor flows through the blades 14, the reactive vapor forms a diffusion coating on the surfaces of the passages 18 before exiting the blades 14, either through the cooling holes 46 (e.g., corresponding to the forward operation depicted in FIG. 1) or through the openings 44 (e.g., corresponding to the reverse operation depicted in FIG. 2). While within the inner chamber 24, the reactive vapor can also react with the exposed external surfaces of the blades 14 to form a diffusion coating on the external surfaces. Alternatively, a separate mixture could be provided to supply the inner chamber 24 with a different reactive vapor, so that a different coating composition is deposited on the external surfaces of the blades 14. For example, if the lower chamber 22 contains chromium pellets and $NH_4Cl$ activator, and the upper chamber 23 contains CrAl pellets and $AlF_3$ activator, a chromide diffusion coating will deposit on the shank areas of the internal passages 18 during forward flow, and an aluminide coating will deposit on the external surfaces of the blades 14 and the internal surfaces of the passages 18 closest to the cooling holes 46. Because the chromide vapors would be depleted fairly quickly after entering the blades 14 through the openings 44, there would be minimal cross contamination of the donor mixture 16 in the upper chamber 23. Conversely, the activity of the vapors generated in the chamber 23 can be controlled such that there is minimal contamination of the donor mixture 16 in the lower chamber 22 when depositing the internal aluminide coating during reverse flow.

The valve assembly 34 can be controlled manually or automatically to reverse the flow of the reactive vapor through the internal passages 18 of the blades 14. By appropriately timing the operation of the valve assembly 34 to periodically reverse the flow of reactive vapors through the can 20, a more uniform coating thickness can be achieved throughout the internal passages 18 of the blades 14. In particular, whereas a flow direction in which the reactive vapors enter the blades 14 from the openings 44 in their root sections will tend to deposit coatings more efficiently adjacent the openings 44 but produce a thinner coating adjacent the cooling holes 46 and a nonuniform coating thickness along the lengths of the passages 18, reversing the flow direction through the blades 14 will reverse this tendency, causing more efficient coating deposition adjacent the cooling holes 46 and a thinner coating adjacent the openings 44. As a result, selectively cycling between forward and reverse flow directions can be used to produce a more uniform coating thickness throughout the interiors of the blades 14. Suitable cycling periods will depend on the reactivity of the reactive vapors, the flow rate of the carrier gas, processing temperature, length and complexity of the internal passages 18, the desired internal coating thickness profile, etc. In generally, it is believed that switching the flow direction once roughly half way through the coating process, for example, after about three hours of a six-hour coating cycle, will achieve acceptable results when depositing a diffusion aluminide coating on the internal cooling passages of most gas turbine blades. However, it is within the scope of the invention to switch the flow direction multiple times, for example, every few minutes to every few hours.

In an investigation leading up to this invention, laboratory trials were performed with a vapor flow system similar to that represented in FIGS. 1 and 2. The trials were performed on stage one high pressure turbine blades (HPTB) of the CF6-80C2 gas turbine engine. The trial conditions for all blades were as follows: carrier gas and flow rate—argon at about 40 scfh; donor material—CrAl; activator—$AlF_3$; coating temperature—about 1975° F. (about 1080° C.); coating duration—about six hours total. A control group of blades underwent coating using conventional single-direction flow, while an experimental group of blades underwent coating using the flow reverse-switching technique of the present invention. In the trial, flow was reversed through the experimental blades after approximately three hours (of the six-hour treatment). Following the coating operations, the blades were examined for coating thickness within eight cooling passages at locations corresponding to the 20% span of each blade (20% of the distance from the top of the blade platform to the tip of the airfoil). The results of the examination revealed that the internal coating thickness uniformity in the areas of most interest (passages that historically have had the thinnest internal coatings for this blade design) was improved by about 64%, while the ratio of internal to external coating thickness was improved by about 85%.

While the invention has been described in terms of a preferred embodiment, it is apparent that other forms could be adopted by one skilled in the art, such as by substituting other suitable coating and substrate materials and process parameters. Furthermore, it should be noted that the can 20, its structures (e.g., the conduits 26 and 28, chambers 22, 23, and 24, and openings therebetween), and its contents (e.g., the donor mixtures 16) are not limited to the particular orientations and placements relative to the components being coated in FIG. 3. Accordingly, the scope of the invention is to be limited only by the following claims.

The invention claimed is:

1. A method of depositing first and second diffusion coatings on first and second surface portions of at least one internal passage within a component, the method comprising:

providing a retort that comprises an interior, an inlet and an outlet to the interior, a coating chamber within the interior, first and second conduits within the interior and coupled to the coating chamber, a first shuttle valve within the interior and fluidically connected to the coating chamber through the first conduit, and a second shuttle valve within the interior and fluidically connected to the coating chamber through the second conduit;

placing the component within the coating chamber so that the first conduit fluidically communicates with at least a first opening in the component and the second conduit fluidically communicates with at least a second opening in the component;

heating the retort so as to heat the coating chamber, the first and second conduits, the first and second shuttle valves, and the component within the coating chamber;

generating first and second reactive vapors within the coating chamber;

delivering a carrier gas through the first shuttle valve, through the first conduit and then into the coating chamber to force a quantity of the first reactive vapor to enter the internal passage through at least the first opening in the component, flow through the internal passage in a first direction, exit the component through at least the second opening in the component, flow through the second conduit to the second shuttle valve, and vent into the interior of the retort through the second shuttle valve, wherein the first reactive vapor forms the first diffusion coating on the first surface portion of the internal passage as the first reactive vapor flows therethrough; and then delivering the carrier gas through the second shuttle valve, through the second conduit and then into the coating chamber to force a quantity of the second reactive vapor to enter the internal passage through at least the second opening in the component, flow through the internal passage in a second direction opposite the first direction, exit the component through at least the first opening in the component, flow through the first conduit to the first shuttle valve, and vent into the interior of the retort through the first shuttle valve, wherein the second reactive vapor forms the second diffusion coating on the second surface portion of the internal passage as the second reactive vapor flows therethrough; and flowing a gas through the inlet of the retort and removing the gas through the outlet of the retort to purge the interior of the retort of the first and second reactive vapors vented into the interior through the first and second shuttle valves.

2. The method according to claim 1, wherein the first diffusion coating has a thickness adjacent the first opening that is approximately equal to a thickness of the second diffusion coating adjacent the second opening.

3. The method according to claim 1, wherein the first and second reactive vapors differ in composition and/or reactivity.

4. The method according to claim 1, wherein flow of the first and second reactive vapors is reversed from the first direction to the second direction by controlling the delivery of the carrier gas to the first and second shuttle valves within the retort with a valve assembly located outside the retort.

5. The method according to claim 4, wherein the first and second reactive vapors are generated within the coating chamber by reacting first and second metallic sources with first and second activators located within the coating chamber.

6. The method according to claim 1, wherein floats within the first and second shuttle valves vent the second and first reactive vapors, respectively, and prevent the second and first reactive vapors, respectively, from entering the valve assembly.

7. The method according to claim 1, wherein the first and second diffusion coatings are formed of at least one material chosen from the group consisting of aluminides and chromides.

8. The method according to claim 1, wherein the component is a gas turbine engine component and the internal passage is an internal cooling passage of the gas turbine engine component.

9. A method of depositing first and second diffusion coatings on first and second surface portions of at least one internal passage within a gas turbine engine blade, the first surface portion being adjacent at least a first opening located in a blade root section of the blade and the second surface portion being adjacent at least a second opening located in a blade tip section of the blade; the method comprising:

providing a retort that comprises an interior, an inlet and an outlet to the interior, a coating chamber within the interior, first and second conduits within the interior and coupled to the coating chamber, a first shuttle valve within the interior and fluidically connected to the coating chamber through the first conduit, and a second shuttle valve within the interior and fluidically connected to the coating chamber through the second conduit;

placing the blade within the coating chamber so that the first conduit fluidically communicates with the first opening of the blade and the second conduit fluidically communicates with the second opening of the blade;

heating the retort so as to heat the coating chamber, the first and second conduits, the first and second shuttle valves, and the blade within the coating chamber;

generating first and second reactive vapors within the coating chamber;

delivering a carrier gas through the first shuttle valve, through the first conduit and then into the coating chamber to force a quantity of the first reactive vapor to enter the internal passage through the first opening in the blade, flow through the internal passage in a first direction, exit the blade through the second opening in the blade, flow through the second conduit to the second shuttle valve, and vent into the interior of the retort through the second shuttle valve, wherein the first reactive vapor forms the first diffusion coating on the first surface portions of the internal passage as the first reactive vapor flows therethrough; and then delivering the carrier gas through the second shuttle valve, through the second conduit and then into the coating chamber to force a quantity of the second reactive vapor to enter the internal passage through the second opening in the blade, flow through the internal passage in a second direction opposite the first direction, exit the blade through the first opening in the blade, flow through the first conduit to the first shuttle valve, and vent into the interior of the retort through the first shuttle valve, wherein the second reactive vapor forms the second diffusion coating on the second surface portions of the internal passage as the second reactive vapor flows therethrough; and flowing a gas through the inlet of the retort and removing the gas through the outlet of the retort to purge the interior of the retort of the first and second reactive vapors vented into the interior through the first and second shuttle valves.

10. The method according to claim 9, wherein the first and second reactive vapors differ in composition, one of the first and second portions of the diffusion coating is a chromide, and the other of the first and second portions of the diffusion coating is an aluminide.

* * * * *